United States Patent [19]

Nilsson

[11] Patent Number: 4,538,587

[45] Date of Patent: Sep. 3, 1985

[54] DRESSING DEVICE

[76] Inventor: Bengt Nilsson, Ängsvägen 9, 531 55 Lidköping, Sweden

[21] Appl. No.: 569,834

[22] Filed: Jan. 11, 1984

[30] Foreign Application Priority Data

Feb. 14, 1983 [SE] Sweden ..... 8300784

[51] Int. Cl.[3] ..... B24B 53/08

[52] U.S. Cl. ..... 125/11 TP; 125/11 CD; 74/568 FS

[58] Field of Search ..... 74/568 FS; 125/11 TP, 125/11 PH, 11 PT, 11 CD; 51/59 R

[56] References Cited

U.S. PATENT DOCUMENTS

| | | | |
|---|---|---|---|
| 2,459,923 | 1/1949 | Crompton | 125/11 TP |
| 2,571,818 | 10/1951 | Blodgett | 74/568 R |
| 2,733,701 | 2/1956 | Brady | 125/11 TP |
| 3,099,853 | 8/1963 | Bills | 51/59 R |
| 3,792,627 | 2/1974 | Tarello | 74/568 FS |
| 3,853,021 | 12/1974 | Hayes | 74/568 FS |

*Primary Examiner*—Harold D. Whitehead

[57] ABSTRACT

A device for dressing a regulating wheel in a centerless grinding machine is adjustable for adapting the shape of the envelope surface of the regulating wheel to work pieces of different diameters. For this purpose, the dressing point (3) is arranged in a support (4) which co-operates with a follower (12) which is movable along a forming bar (9). The surface (11) on the forming bar which contacts the follower can be given a variable curve by the fact that the forming bar is provided with means (16, 20) for achieving elastic deformation of the forming bar in a plane coinciding with the path of the follower (12).

2 Claims, 2 Drawing Figures

FIG. 1
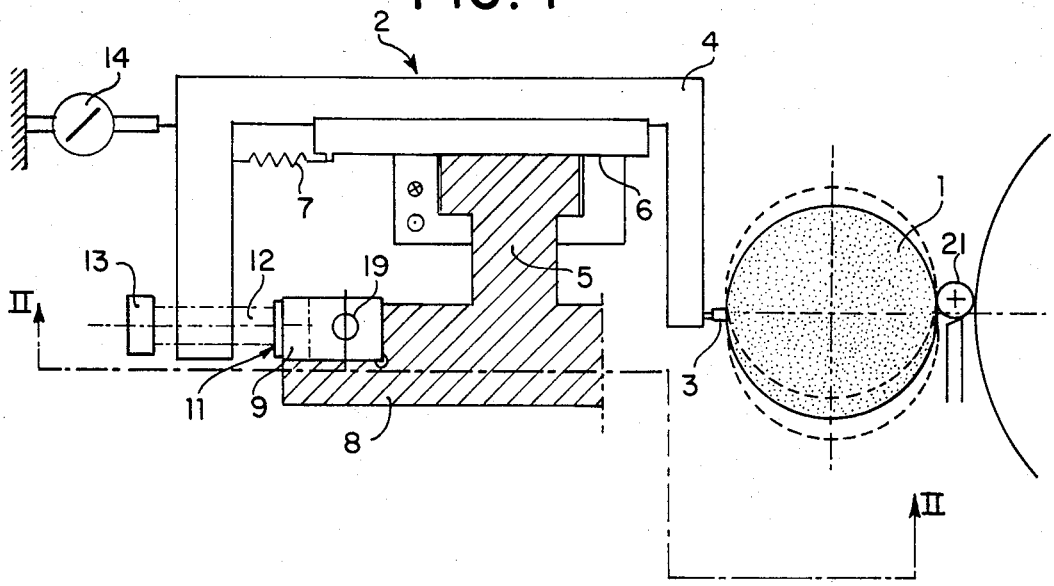
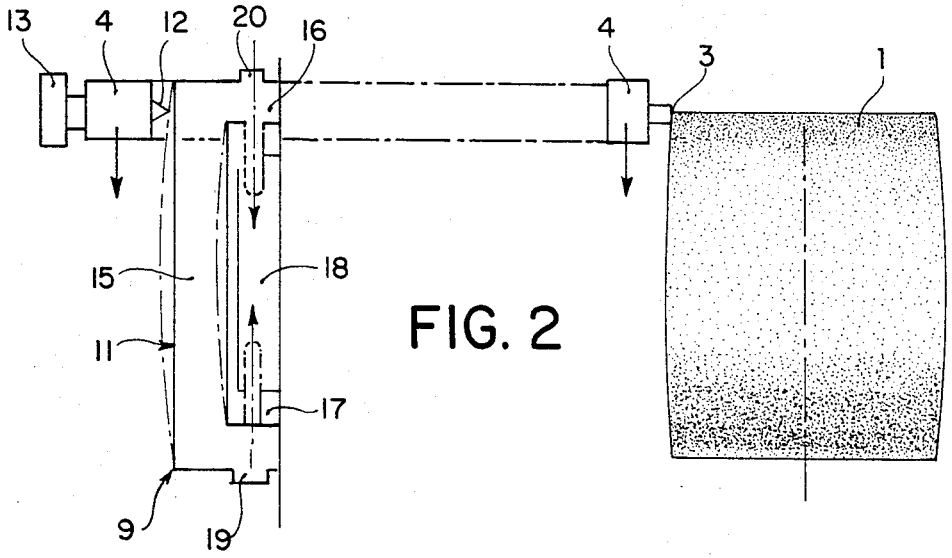
FIG. 2

DRESSING DEVICE

FIELD OF THE INVENTION

The present invention relates to a device for dressing the regulating wheel in a centerless grinding machine with through-feed, which comprises a dressing point arranged on a movable support which together with the dressing point is displaceable in a plane along the regulating wheel, the rotational axis of the regulating wheel being inclined in relation to said plane.

BACKGROUND OF THE INVENTION

When grinding cylindrical work pieces with through-feed in a centerless grinding machine, the axial feed of the work pieces is carried out by the fact that the axis of the regulating wheel is inclined in relation to the axis of the grinding wheel, whereby an axial force component from the regulating wheel acts on the work pieces. In order to maintain a sufficient coefficient of friction between the regulating wheel and the work pieces and to maintain a suitable shape of the regulating wheel, the regulating wheel is dressed from time to time, whereby a dressing device, usually comprising a diamond point, is move along the envelope surface of the regulating wheel, thereby removing a surface layer of said wheel. The dressing device is thereby in the most simple manner moved in a path describing a straight line parallel to the feed path describing a straight line parallel to the feed path of the work pieces while the regulating wheel rotates around an axis which is inclined as mentioned above. Such a dressing procedure gives a hyperbolic shape of the regulating wheel envelope surface. It is for various reasons that the work pieces have the longest possible line contact with the regulating wheel, but since the work pieces have cylindrical shape, i,e, they have a certain thickness, line contact can, in theory, not be established between a work piece and a regulating wheel which is shaped according to the above, and the conditions deteriorate with increased work piece diameter.

It is known to compensate for said contact line inaccuracy by increasing the inclination of the regulating wheel after the dressing operation, but this method is impractical because it entails that the inclination of the regulating wheel has to be changed before and after every dressing operation. Another compensation method is to incline the path of the work pieces through the machine, but this method is practicable only for short work pieces and also influences the contact between the grinding wheel and the work pieces. In order to achieve line contact, it is also possible to use a dressing device in the shape of a roller with the same diameter as the work piece. Such a solution is, however, expensive because the cost of each dressing roller is high, and different rollers must be used for different work piece diameters. Further, it would be necessary to provide driving means for the roller in order to make it rotate.

Another solution, which is shown in e.g. the U.S. Pat. No. 2,459,923, is to provide a dressing point on support which is movable along the regulating wheel and let the path of the dressing point be determined by a forming bar with a cylindrical surface which co-operates with a follower connected to the support, whereby in order to adapt to different diameters the bar can be turned in a plane mainly perpendicular to the direction of the pressing force of the follower against the bar.

This solution has the disadvantage that the follower has to follow a curve along a surface which is curved in several perpendicular planes when the bar is inclined, which results in oblique load and imperfect forming accuracy in the dressing operation.

It is known to make a forming bar at least partially elastically deformable so that it can be bent by applying one or more forces produced by adjusting screws directed mainly perpendicular to that surface of the bar which defines the path of the dressing point. Such devices are shown in e.g. the Swedish Patent publication No. 314,008, the German Offenlegungsschrift No. 2,153,201 and the U.S. Pat. Nos. 2,073,577 and 2,282,038. It is difficult to give the surface the desired arc shape in such devices. A plurality of adjusting screws are required in order to achieve a variable curve radius and maintained arcuate shape which entails complicated manufacture and handling. If deformation is carried out by only one adjusting screw, the curvature becomes non-circular except possibly regarding bars with flexible parts shaped in a special way at a certain degree of deformation, which entails a limited usefulness and precision. The perpendicular direction of the screws makes it necessary to take up reactive forces.

SUMMARY OF THE INVENTION

The purpose of the present invention is to achieve a dressing device which consists of simple and inexpensive components and with which the regulating wheel can be dressed in a simple manner into an accurate shape which gives the desired contact with the work pieces. This is achieved according to the invention by providing the device with the characterizing features stated in the appended claim.

A device according to the invention can easily be given the desired shape by adjusting the curvature in a single plane so that dressing with a diamond point gives the envelope surface of a regulating wheel shapes which are suitable for adaptation to work pieces with different diameters.

DESCRIPTION OF THE DRAWINGS

The following is a detailed description of the invention with reference to the annexed drawing, in which FIG. 1 shows a schematic lay-out of the dressing device and parts of adjoining portions of the grinding machine according to one embodiment of the invention, and FIG. 2 shows the forming bar comprised in the device and its adjusting members in a view according to II—II in FIG. 1.

DESCRIPTION OF THE PREFERRED EMBODIMENT

FIG. 1 shows the principal build-up of the invention; the relative sizes of the elements comprised in the device may deviate from the real conditions. The regulating wheel of the grinding machine is given the reference numeral 1 and its axis of rotation is arranged at an angle to the normal of the plane of the paper. A dressing device 2 comprising a diamond point 3 arranged in a support 4 is movable in a mainly horizontal direction perpendicular to the plane of the paper. A guide 5 is arranged as a support and bearing for a bed 6 for the support 4. The bed 6 with the support 4 and the point 3 are displaceable along the guide 5, and the support 4 is in its turn displaceable in the plane of the paper on the bed 6, so that the point 3 can be brought into contact with the envelope surface of the regulating wheel 1. The support 4 is subjected to force directed to the right in the figure by a spring 7. A forming bar 9 is arranged on a foundation 8. The bar 9 has a mainly flat surface 11 along which a follower 12 in the form of a sliding shoe arranged in connection to the support 4 can slide when the dressing device 2 is displaced along the guide 5. The position of the follower 12 on the support 4 can be adjusted by a positioning screw 13 so that the position of the point 3 can be adapted to varying diameters of the regulating wheel 1. The position of the support can be indicated on an indicator 14.

FIG. 2 shows how the bar 9 is designed. It comprises an extended portion 15 provided with the surface 11 which is contacted by the follower. The device has means for accomplishing elastic deformation of the forming bar and thereby variation of curvature of the surface 11 in a plane which coincides with the path of the follower. For this purpose, in the embodiment shown each end of the extended portion 15 is provided with legs 16, 17 giving the bar a U-shape. A tensioning member, in the embodiment shown having the form of a bar 18, is extending between the legs 16, 17. Each end of the bar has a threaded bore in which a screw 19, 20 is provided. The respective screws are abutting a supporting surface on each leg and press the legs towards each other when they are tightened, whereby the forming bar is deformed elastically so that the curve of the surface 11 is changed in a plane coinciding with the path of the follower 12. Thus, the path of the dressing point 3 along the regulating wheel can be varied by tightening one or both of the screws 19, 20. Possibly one end of the bar 18 can be connected to one of the legs of the forming bar by other means. The forming bar is suitably made of a hardened tool steel. In a forming bar having a length of about 450 mm and a mainly square cross section of about 35×35 mm, the position of the middle of the surface 11 can be displaced about 0,4 mm from the condition in which the surface 11 is flat to the condition in which the surface has a maximum curve, within the area of elastic deformation. In this area the curve of the surface 11 is approximately arcuate, which gives a suitable shape of the envelope surface of the regulating wheel 1. Said variation of the curve makes it possible to adapt the shape of the regulating wheel to work pieces (21 in FIG. 1) whose diameter may vary between limits determined by the capacity of a normal grinding machine in other respects. Each given work piece diameter corresponds to an optimum curve of the surface 11. The curve can be adjusted by e.g. placing the follower 12 in the middle of the surface 11 and unloading the tensioning member 18, 19, 20 totally. Thereafter the measuring indicator 14 is connected to the support 4 and the tensioning member is tightened until the indicator shows the deformation of the forming bar which corresponds to the desired curve of the surface 11.

I claim:

1. Apparatus for dressing a regulating wheel (1) having a rotational axis in a centerless grinding machine, comprising:

a dressing point (3) mounted on a movable support (4) such that movement of the support results in movement of the dressing point along a path on said regulating wheel, wherein said rotational axis is inclined with respect to said path;

a forming bar (9) of U-shaped cross section having an elongated normally flat surface (11) having predetermined flexibility and disposed generally parallel to the path of the dressing point;

a follower (12) mounted on said movable support (4) engageable with said surface whereby movement of said follower along said surface effects movement of said dressing point (3) against said regulating wheel; and tensioning means positioned between the legs of said U-shaped forming bar and operable to draw said legs toward one another and thereby effect flexure of said elongated forming bar surface and outward bowing thereof to a predetermined curvature whereby the curvature formed on the regulating wheel by the dressing point may be selectively varied solely by adjustment of said leg tensioning means.

2. Apparatus as claimed in claim 1 wherein said tensioning means comprises a bar (18) which at least at one end has an axial threaded bore cooperating with a screw (19, 20) connected to one of said legs of said forming bar.

* * * * *